US006969091B2

(12) United States Patent
Hilicki et al.

(10) Patent No.: US 6,969,091 B2
(45) Date of Patent: Nov. 29, 2005

(54) COIN DISPLAYING BOOK

(75) Inventors: Richard Hilicki, Brentwood, TN (US); Harold Anderson, Atlanta, GA (US)

(73) Assignee: Anderson Press Incorporated, Atlanta, GA (US)

( * ) Notice: Subject to any disclaimer, the term of this patent is extended or adjusted under 35 U.S.C. 154(b) by 0 days.

(21) Appl. No.: 10/273,898

(22) Filed: Oct. 16, 2002

(65) Prior Publication Data

US 2003/0030268 A1 Feb. 13, 2003

Related U.S. Application Data

(63) Continuation of application No. 09/606,426, filed on Jun. 28, 2000.

(51) Int. Cl.[7] ..... A63H 3/40

(52) U.S. Cl. ..... 281/29; 281/15.1; 281/21.1; 281/22; 281/31; 281/51; 283/5; 283/50; 283/51; 283/52; 283/52.1; 283/53; 283/63.1; 283/903; 206/8; 206/82; 206/83; 206/84; 206/81; 206/457; 206/472; 206/486; 206/840; 40/159; 40/537; 40/661; 40/725; 40/776; 434/317

(58) Field of Search ..... 281/15.1, 21.1, 281/29, 31, 22, 51; 206/82, 83, 84, 486, 840, 206/8, 81, 457, 472; 40/159, 537, 776, 725, 40/661; 283/5, 50, 51, 52, 52.1, 53, 63.1, 283/903, 8, 81, 457; D99/34, 35, 36, 37, D99/38; D19/26, 28, 33, 3; 434/317

(56) References Cited

U.S. PATENT DOCUMENTS

| | | | | |
|---|---|---|---|---|
| 1,168,392 A | * | 1/1916 | Gruettner | 283/63.1 |
| 1,719,962 A | * | 7/1929 | Beistle | 206/0.8 |
| 2,258,535 A | | 10/1941 | Buranelli | 206/0.84 |
| 2,318,850 A | * | 5/1943 | Grant | 206/0.83 |
| 2,489,240 A | * | 11/1949 | Meyer | 446/147 |
| 2,521,792 A | * | 9/1950 | Hollander | 206/0.83 |
| 2,844,248 A | | 7/1958 | Tiberio | 206/0.83 |
| 2,862,309 A | * | 12/1958 | Von der Hellen | 434/156 |
| 2,985,284 A | | 5/1961 | Levy | 206/0.83 |

(Continued)

FOREIGN PATENT DOCUMENTS

GB 0705459 * 3/1954

OTHER PUBLICATIONS

Ray Miller et al., "The 50 States Quarters", Tenagerine Press, ISBN 0-439-20822-X.

*Primary Examiner*—Derris Banks
*Assistant Examiner*—Mark Henderson
(74) *Attorney, Agent, or Firm*—Fish & Neave IP Group; Robert W. Morris; Jeffrey D. Mullen

(57) ABSTRACT

A book that is capable of displaying one or more coins related to its theme, including a front cover and a back cover. At least one book cover defines one or more apertures that are capable of receiving coins. The book theme is displayed on at least one of the book covers. The book may optionally include one or more caps that may be inserted into and removed from the coin-receivable apertures. These caps will preferably display images that are related to the theme of the book. The invention provides a coin specific display that stores and displays one or more coins in an appealing manner, and that also conveys or provides additional information about the theme displayed on the coin.

14 Claims, 4 Drawing Sheets

U.S. PATENT DOCUMENTS

| | | | | | |
|---|---|---|---|---|---|
| 3,047,144 | A | | 7/1962 | Wissel | 206/0.83 |
| 3,178,014 | A | | 4/1965 | Goldwasser | 206/0.83 |
| 3,245,523 | A | * | 4/1966 | White | 206/0.83 |
| 3,622,771 | A | * | 11/1971 | Franc | 362/99 |
| 3,809,217 | A | | 5/1974 | Harrison | 206/0.84 |
| 3,913,732 | A | * | 10/1975 | Peterson | 206/0.83 |
| 3,957,157 | A | | 5/1976 | Therrien | 206/0.84 X |
| 4,249,757 | A | * | 2/1981 | Gella | 281/15.1 |
| 4,365,438 | A | * | 12/1982 | Nelson | 446/75 |
| 4,385,688 | A | * | 5/1983 | Grant | 206/0.83 |
| 4,402,399 | A | | 9/1983 | Friess | 206/0.84 X |
| 4,429,787 | A | * | 2/1984 | Morse | 206/0.83 |
| 4,771,557 | A | | 9/1988 | Bowman | 40/771 |
| 4,951,404 | A | * | 8/1990 | Lithwick | 40/124.06 |
| 4,979,619 | A | | 12/1990 | Hager | 40/771 |
| 5,031,935 | A | * | 7/1991 | D'Andrea | 281/15.1 |
| 5,119,574 | A | * | 6/1992 | King | 40/537 |
| D331,421 | S | * | 12/1992 | Ross | D19/33 |
| 5,201,525 | A | | 4/1993 | Castro | 40/771 Z |
| 5,419,705 | A | * | 5/1995 | Sandvik | 434/317 |
| D389,181 | S | * | 1/1998 | Fernandes et al. | D19/26 |
| 5,788,286 | A | * | 8/1998 | Hunt | 283/117 |
| 5,884,755 | A | | 3/1999 | Vaccarella | 206/0.84 X |
| 6,032,790 | A | | 3/2000 | Soutchkov et al. | 206/84 X |
| D430,719 | S | | 9/2000 | Tolle | |
| D432,571 | S | * | 10/2000 | Cercone et al. | D19/30 |
| 6,128,840 | A | | 10/2000 | Boisvert | 40/323 X |
| 6,135,844 | A | * | 10/2000 | D'Andrea | 446/75 |
| 6,205,693 | B1 | | 3/2001 | Pliler et al. | |
| 6,224,106 | B1 | * | 5/2001 | Murphy | 281/15.1 |
| D443,750 | S | | 6/2001 | Reidenbach | D99/34 |
| 6,279,956 | B1 | * | 8/2001 | Kaufman | 281/31 |
| 6,319,088 | B1 | * | 11/2001 | Cole et al. | 446/343 |
| 6,453,592 | B1 | * | 9/2002 | Pliler et al. | 40/776 |
| 6,517,407 | B1 | * | 2/2003 | Peters | 446/147 |
| 6,554,130 | B1 | | 4/2003 | Krull et al. | 206/8 |
| 2003/0014892 | A1 | * | 1/2003 | Matsuda | 40/661 |

* cited by examiner

COIN DISPLAYING BOOK

CROSS REFERENCE TO RELATED APPLICATION

This application is a continuation of U.S. patent application Ser. No. 09/606,426, filed Jun. 28, 2000, which is hereby incorporated by reference herein in its entirety.

BACKGROUND OF THE INVENTION

This invention relates to displays for collecting coins. More specifically, the present invention is directed to books that are capable of displaying coins that are related to their themes.

Collecting and displaying coins is a very popular hobby. Government mints all over the world produce coins for circulation in their general populations. These coins often display images that portray political or historic figures or historic or other events that are somehow related to the issuing country. In the United States, for example, penny, nickel, dime, quarter, half-dollar and whole dollar coins that display presidents, political and other historic figures are readily available.

Most recently, the United States Mint has begun issuing representative quarters for each of the 50 United States. A state specific design is displayed on one side of each such quarter. For example, the quarter that represents Delaware depicts the historic horseback ride of Caesar Rodney, the Delaware delegate to the Continental Congress who cast the deciding vote in favor of independence from Great Britain. The quarter that represents Pennsylvania depicts the statue "Commonwealth" which sits atop dome of the state building, while the quarter that represents Massachusetts features a Minuteman of the American Revolution. A familiar image of former President George Washington is displayed on the second side of each coin.

The U. S. Mint is also producing a new gold color dollar coin that depicts Sacagawea, the Shoshone Indian woman who assisted the Lewis and Clark expedition. The U.S. Mint has issued numerous other similar coins. Examples include a bicentennial quarter, issued just prior to 1976, half-dollar that features John F. Kennedy and a previous dollar coin that featured Susan B. Anthony.

The United States is not the only country that issues such coins. For example, the Royal Canadian Mint is currently issuing coins with a new design each month. Themes of coins that have been issued are "The Airplane Opens the North," "Ingenuity," "Achievement," and "Health." The Royal Canadian Mint also issues coins that represent the various years of the Chinese lunar calendar, and had a program similar to that currently underway in the United States, where it issued representative coins for each of its provinces. Other countries issue coins that display political, historic and other figures and events as well.

Coins that are not used as currency are also available and are popular items for collectors. For example, tokens of all types are distributed by numerous sources. Transportation tokens may be used to gain access to public transportation services, or to cross bridges or pass through tunnels. Tokens and medallions are distributed by companies for the purpose of advertising their products. Such tokens and medallions are also available to memorialize or commemorate wars, holidays, political, social, athletic and numerous other events.

Collectors take great pride in collecting and displaying coins such as those described above. Available coin holders and displays typically include rigid sheets with coin-sized holes that are arranged in an organized pattern. The holes are sized such that the coin to be displayed can be pressed inside in a tight fit. Some coin holders are configured as folding books, with the coin-sized holes arranged on the inside of one or more of the folding surfaces. Others are simply configured as flat surfaces without covers. Coin holes are often arranged in a row and column or similar format.

While such coin holders are perfectly adequate for storing and displaying coins, theme-related displays are more appealing. For example, U.S. Pat. No. 5,988,366 to Krull, et al., issued Nov. 23, 1999 discloses a map of the United States with coin-sized holes inside the borders of or next to each state. Collectors enjoy displaying coins that represent states in a map such as this.

While a map such as that described above may be useful for displaying coins that represent states or other geographic regions, it will typically not be used to display the coins from a single state or to display coins that do not relate to a geographic theme. Further, and more significantly, such a display generally does not allow for anything more than the display of coins in a manner that corresponds to their geographic location. While a limited amount of information may be provided ancillary to the display, for example, in the borders of the map, there is typically no way to provide a large amount information about the location, event or character that is displayed on the coins. There is also no way for the collector to record his or her own thoughts, observations or other information about the coins displayed. Thus, coin collectors will probably not want to use a map-type display to display coins that portray characters, historic or commemorative events or other non-geographically related themes, or to display coins when they would also like to convey or incorporate information that relates to the theme of the coin.

It is therefore desirable to provide a coin display that relates to a non-geographically related theme in an entertaining manner.

It is also desirable to provide a coin display that stores and displays a coin in an apparatus that is also capable of providing additional information about the theme displayed on the coin.

SUMMARY OF THE INVENTION

In accordance with an aspect of the present invention, there is provided a book that is capable of displaying one or more coins related to its theme, which includes a front cover and a back cover, wherein at least one of these book covers defines one or more coin receivable apertures, and wherein the book theme is displayed on at least one of the book covers.

In accordance another aspect of the present invention, such book themes may relate to geographic regions, such as cities, counties, states, countries, provinces, continents and other definable geographic regions. Other themes may include fictional and non-fictional characters, as well as commemorative, athletic and historic events.

In accordance with yet another aspect of the present invention, the book may include one or more caps that may be inserted into and removed from the coin receivable apertures. These caps will preferably display images that are related to the theme of the book.

BRIEF DESCRIPTION OF THE DRAWINGS

The above and other objects and advantages of the invention will be apparent upon consideration of the following detailed description, taken in conjunction with the accompanying drawings, in which like reference characters refer to like parts throughout, and in which.

DETAILED DESCRIPTION OF THE INVENTION

Figure 1:
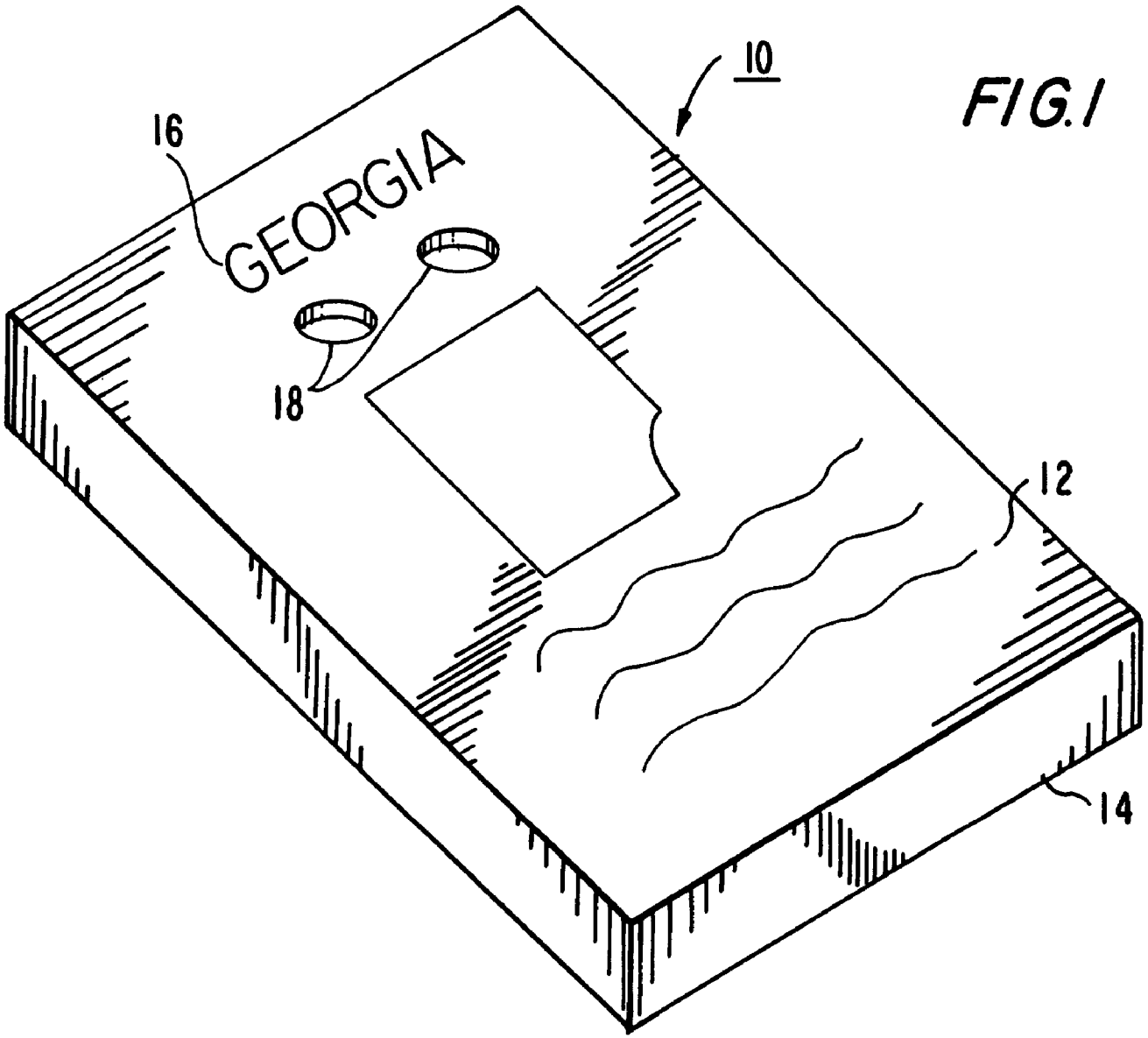
FIG. 1 is a three-dimensional view of a coin displaying book according to an embodiment of the invention.

Turning now to the drawings where examples are provided for the purpose of illustration and not by way of limitation, FIG. 1 includes a three-dimensional view of one embodiment of a book 10 that is capable of displaying one or more coins related to its theme. As shown, book 10 includes a front cover 12 and a back cover 14. In the view of FIG. 1, front cover 12 includes two coin receivable apertures 18. These apertures 18 will preferably be sized such that a coin may be pressed inside in a tight fit. Apertures 18 will also preferably have a shield or some other support (either clear or opaque) on one side to prevent coins that are placed inside from falling through and, if opaque, to provide a surface for display of a theme-related image. Front 12 and back 14 covers will preferably, but not necessarily, be made from card stock or some other rigid material. While book 10 is shown here with apertures 18 located in front cover 12, those skilled in the art will appreciate that they could also be located in rear cover 14 or in both covers. Those skilled in the art will also appreciate that while book 10 is illustrated with two apertures 18 in first cover 12, one aperture or three or more apertures could be provided instead. Those skilled in the art will also recognize that apertures 18 may have different diameters, and that they could therefore be used to hold coins that are different sizes.

Still referring to FIG. 1, the theme 16 of book 10 is preferably displayed on front cover 12. Again, theme 16 could be displayed on back cover 14 or on both covers. For that matter, theme 16 does not have to be displayed on either cover if such an identification is not desired. Georgia, one of the fifty United States, is the theme 16 of book 10 illustrated in FIG. 1. However, book 10 could relate to any theme, and the invention is not limited to states or to any particular state. Other embodiments of the invention include themes 16 that relate to other geographical regions such as provinces (e.g. Ontario, Quebec or other Canadian provinces), countries (e.g. the United States and Canada), continents (e.g. Africa or Asia), and other definable geographic regions (e.g. the European Economic Community, the West Indies, West Africa and other groups of countries). When displayed, theme 16 may be in pictorial, textual or any other practical format.

Figure 2:
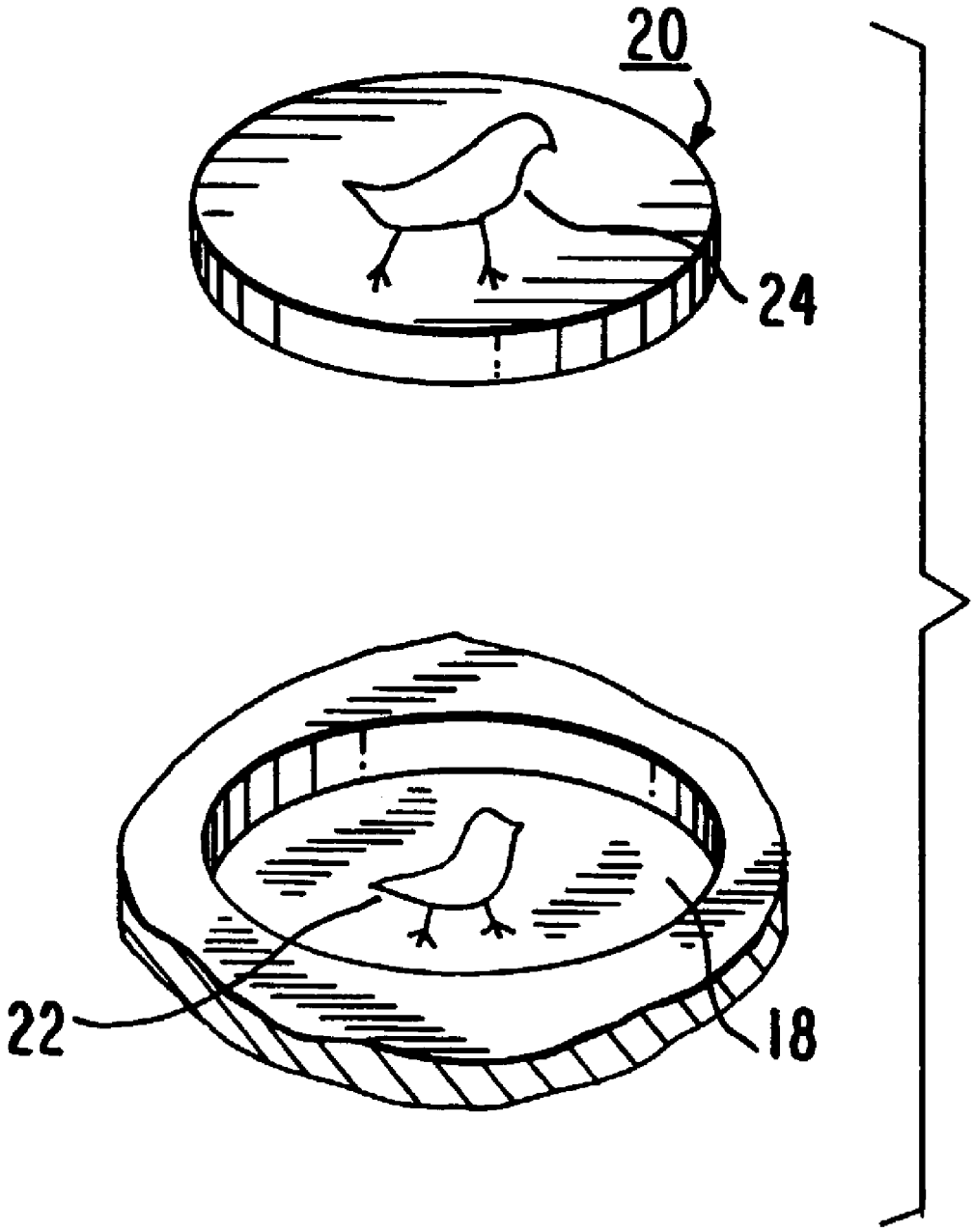
FIG. 2 is a detailed example of a cap placed above an aperture into which it may be inserted according to an aspect of the invention.

Turning now to FIG. 2, an image 22 that is related to theme 16 will preferably be displayed in aperture(s) 18. For example, when theme 16 relates to a state, image 22 may depict a state bird, state flag, state flower, state capitol or some other image that is associated with that state. As is also shown in FIG. 2, a cap 20 may optionally be provided with book 10. Cap 20 will preferably be removable from and insertable into apertures 18. In fact, in the preferred embodiment of the invention, the diameter of cap 20 will have substantially the same size as a coin, which will allow it to form a tight fit inside apertures 18. When an image 22 is present in aperture 18, it will preferably be clearly displayed when cap 20 is removed.

Figure 3:
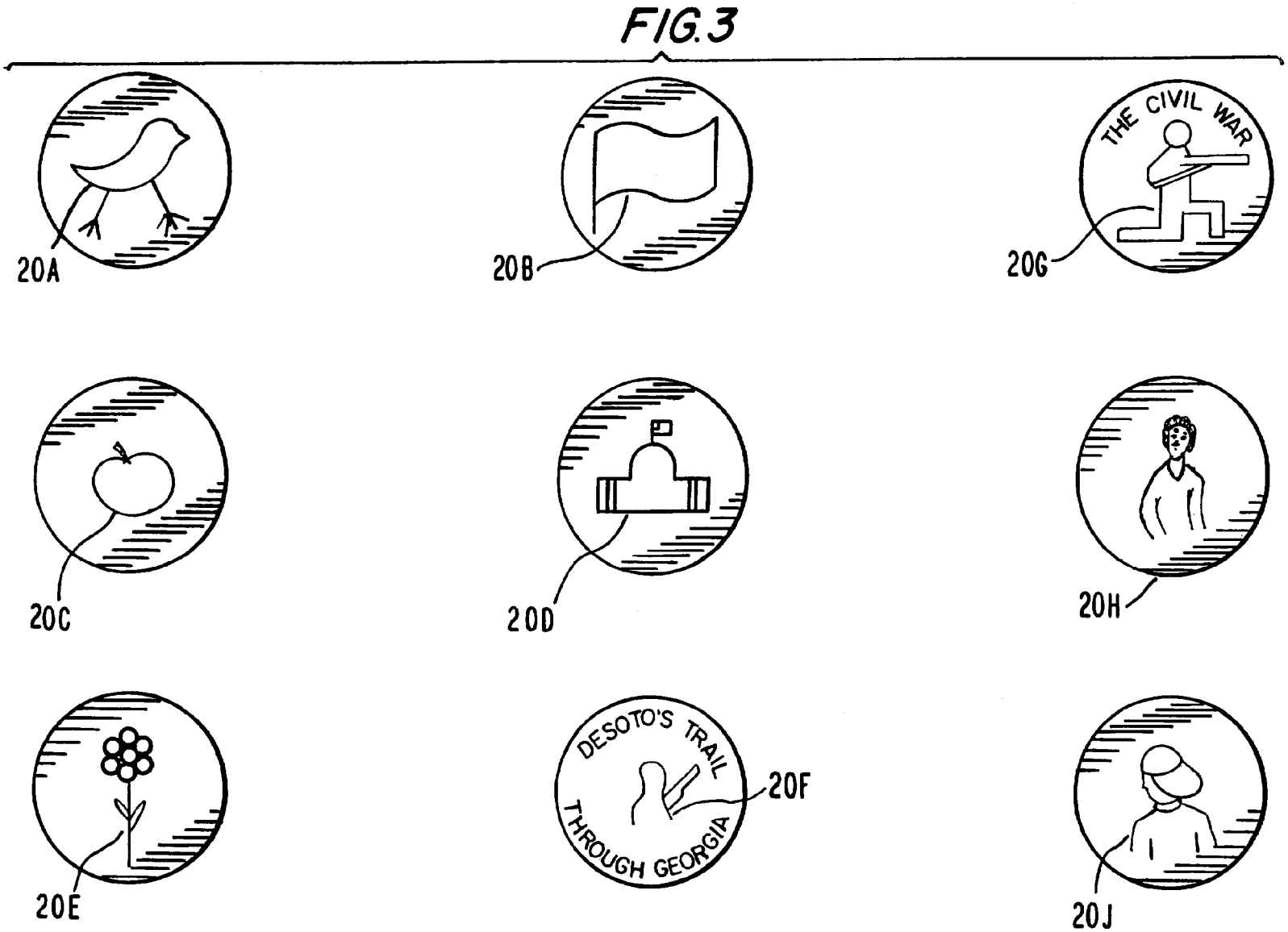
FIG. 3 includes several examples of caps that may be provided with a coin-displaying book according to an aspect of the invention.

Still referring to FIG. 2, cap 20 may also display an image 24 that is related to theme 16. Image 24 may be the same as or different from image 22 in a corresponding aperture 18. Referring to FIG. 3, when theme 16 relates to a state, image 24 may depict a state bird 20A, flag 20B, capitol 20D, flower 20E or some other state related item. In one embodiment of the invention, cap 20 displays a replica 20C of a government-minted coin, such as those described earlier, that is associated with the state described in book 10. In another embodiment of the invention, cap 20 displays a replica of a government-minted coin associated with a Canadian province described in book 10. As indicated earlier, replicas of coins (regardless of whether they are minted by a government entity) that are associated with continents, countries, counties, cities, regions of countries (i.e. the Midwest, the East Coast) and other definable geographic regions can also be included.

As indicated earlier, themes 16 are not limited to geographic locations. In one embodiment of the invention, theme 16 of book 10 relates to a fictional or non-fictional character. Thus, book 10 may include information about a political or historic figure, a popular movie star, an athlete or some other celebrity. Book 10 may also include a story or other information about a fictional character. Other examples of themes 16 include commemorative and historic events. Each of these embodiments may include caps 20 with images 24 that are associated with the relevant theme 16, as well as images 22 in apertures 18 that are associated with theme 16.

Themes that relate to non-fictional characters may include persons that are portrayed on government-minted coins. For example, a book 10 about United States presidents may include aperture(s) 18 sized to hold a John F. Kennedy half-dollar, a George Washington quarter, a Franklin Roosevelt dime, a Thomas Jefferson nickel and/or an Abraham Lincoln penny. In this embodiment of the invention, aperture(s) 18 would obviously have different sizes. If aperture(s) for all five coins are provided, five caps 20 would preferably also be included, with each cap displaying an image 24 that shows a replica of one of the above mentioned coins or another image 24 related to the respective President. Images 22 that show replicas of one or more of the above mentioned coins or something else related to the respective President would also preferably be displayed in aperture(s) 18.

Still another way to practice the invention is with a book 10 with a generalized theme such as, e.g. "The Olympics." In this embodiment, coins that commemorate any or all of the various Olympiads can be stored and displayed in aperture(s) 18. Images 22 or caps 20 that include replicas of these coins, or other images 24 that relate to the relevant Olympiads, may also be provided. Similarly, books 10 with generalized themes that relate, e.g. to "The World Series" or to any of the numerous other professional, college or other amateur sports championships or other events may be used to display caps 20 or coins that relate to those themes. Books 10 about animals, cars, monuments, movies, Broadway shows or other plays and various other events could also be provided to display collected related coins or to display caps 20 that relate to those themes 16.

Figure 4:
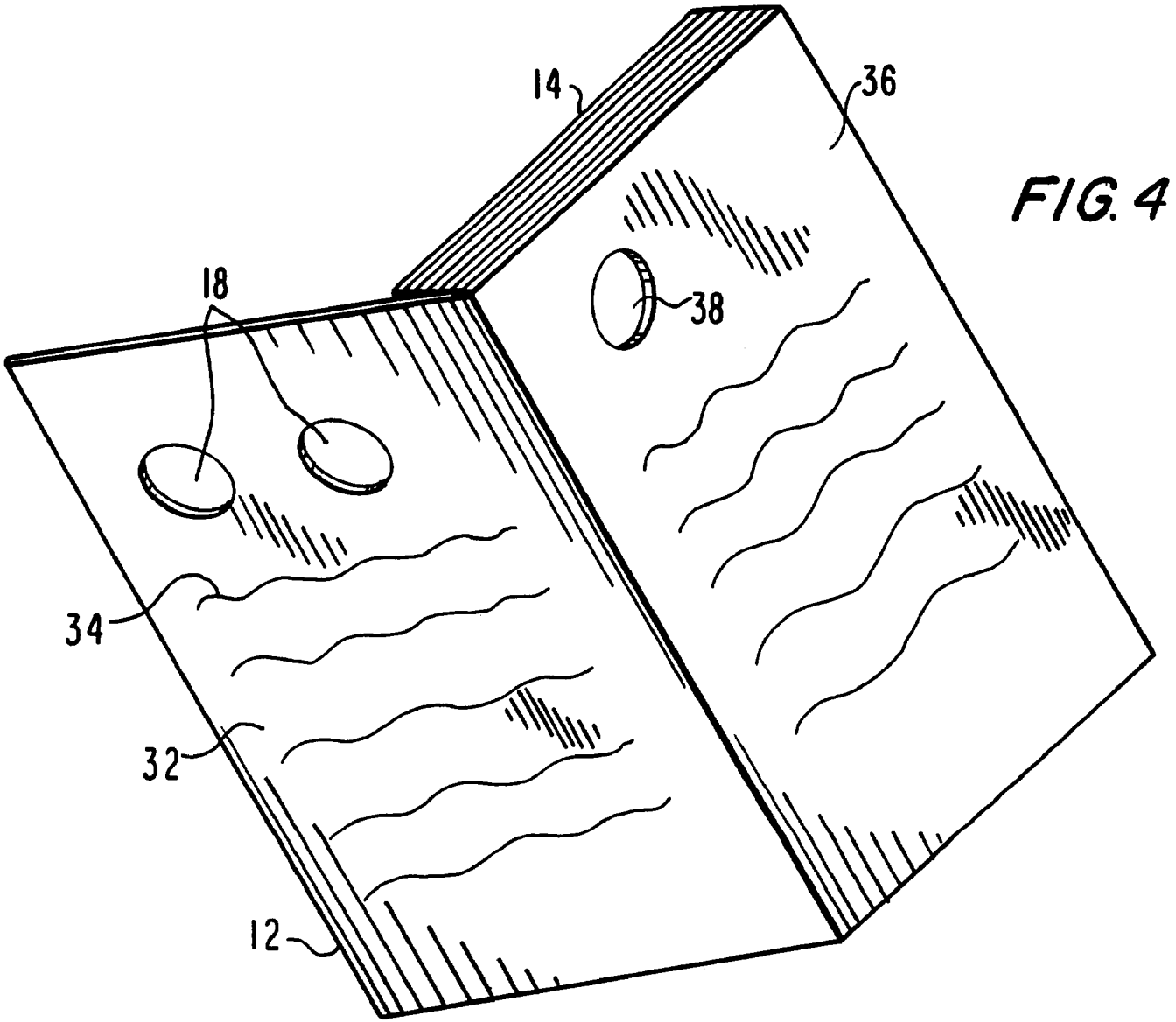
FIG. 4 is a three-dimensional view of a book with sheets that may be present in a coin-displaying book to provide additional information according to an aspect of the invention.

Referring now to FIG. 4, aperture(s) 18 may be provided on the exterior of book 10 (as illustrated in FIG. 1) or on the interior cover 32 of either front cover 12 or back cover 14.

Information other than that which identifies the theme may also be provided on these covers. Thus, a paragraph that contains information about the theme or a picture related to the theme may be provided on either side of either cover.

In the preferred embodiment of the invention, book 10 will include one or more sheets 36 of paper. One or more of sheets 36 may be blank, or all sheets 36 may contain text and/or pictures that describe or otherwise relate to theme 16. The coin collector may, for example, use blank sheets 36 to provide information about his or her personal experiences with the item or person related to theme 16. Thus, blank sheets 36 in a book 10 with a geographically related theme may be used to record information about one's own observations, thoughts or experiences while visiting or studying the location. Another example of a use of the invention is to use blank sheets 36 in a book 10 that relates to living persons to obtain autographs or to record information or notes about the person, while sheets in a book that relates to an historic figure may be used to write a report about that figure. Sheets 36 may also include preprinted information that relates to theme 16. In either case, one or more pages may also include aperture(s) 38 that are aligned with aperture(s) 18 in cover 12 and/or cover 14 to allow for continuous viewing of the coin(s) or cap(s) while the book is being read.

While the preferred embodiment of the invention includes the collection, storage and display of coins, those skilled in the art will recognize that it can be used to collect, store and display caps 20, as well as medallions, medals or any other objects that may be collected, stored and displayed in the manner described.

It is, therefore, apparent that there has been provided, in accordance with the present invention, a book that is capable of displaying coins that are related to its theme that fully satisfies the aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations that fall within the spirit and broad scope of the appended claims.

What is claimed is:

1. A book having a theme and capable of displaying one or more coins related to the theme, comprising:

a book cover having an interior book cover surface and an exterior book cover surface;

a coin-receivable aperture defined in the book cover, wherein the coin-receivable aperture is operable to receive a coin from only one of either the interior and exterior book cover surfaces as any received coin abuts a support when received into said coin-receivable aperture, the coin-receivable aperture is operable to have a received coin removed, and any coin placed in the coin-receivable aperture is viewable from the interior book cover surface; and a plurality of sheets fastened together and bound to the interior book cover surface, wherein each one of the plurality of sheets further comprises:

pre-printed information related to the theme; and an aperture aligned with the coin receivable aperture such that the one sheet does not block any coin inserted into the coin-receivable aperture from being viewable as the book is read.

2. The book of claim 1 wherein the coin-receivable aperture is operable to receive a coin only from the interior surface.

3. The book of claim 1 wherein the support comprises a transparent shield on the coin-receivable aperture on the interior book cover surface such that any coin placed in the coin receivable aperture from the exterior book cover surface abuts the transparent shield.

4. The book of claim 1 further comprising:

a replica of a coin associated with the theme, wherein the coin replica is provided in the coin-receivable aperture.

5. The book of claim 1, wherein the book cover comprises a first book cover joined to a second book cover.

6. A book having a theme and capable of displaying one or more objects related to the theme, comprising: a book cover having an interior book cover surface and an exterior book cover surface;

an aperture defined in the book cover, wherein the aperture is operable to receive an object from only one of either the interior and exterior book cover surfaces as any received coin abuts a support when received into said coin-receivable aperture, the aperture is operable to have a received object removed, and any object placed in the aperture is viewable from at least the interior book cover surface; and a plurality of sheets fastened together and bound to the interior book cover surface, wherein each one of the plurality of sheets further comprises:

pre-printed information related to the theme; and a page aperture aligned with the aperture such that the one sheet does not block any object inserted into the aperture from being viewable as the book is read.

7. The book of claim 6 wherein the aperture is operable to receive a coin only from the interior surface.

8. The book of claim 6 wherein the support comprises a transparent shield on the aperture on the interior book cover surface such that any object placed in the aperture from the exterior surface abuts the transparent shield.

9. The book of claim 6, wherein the book cover comprises a first book cover joined to a second book cover.

10. The book of claim 8 further comprising:

a replica of a coin associated with the theme, wherein the coin replica is provided in the aperture.

11. A book having a theme and capable of displaying a replica of a coin related to the theme, comprising:

a book cover having an interior book cover surface and an exterior book cover surface;

an aperture defined in the book cover, wherein the coin replica is provided in the aperture, the coin replica is removable from only one of the interior and exterior surfaces as the coin replica abuts a support, and the coin replica is viewable from at least the interior book cover surface; and a plurality of sheets fastened together and bound to the interior book cover surface, wherein each one of the plurality of sheets further comprises a page aperture aligned with the aperture such that the one sheet does not block the coin replica from being viewed as the book is read.

12. The book of claim 11 wherein the aperture is operable to receive a coin only from the interior surface.

13. The book of claim 11 wherein the support comprises a transparent shield on the aperture on the interior book cover surface, wherein the aperture is defined in the exterior book cover surface such that the coin replica abuts the transparent shield and is visible from the interior book cover surface.

14. The book of claim 11, wherein the book cover comprises a first book cover joined to a second book cover.

* * * * *